US008881960B1

(12) United States Patent
Gironella

(10) Patent No.: US 8,881,960 B1
(45) Date of Patent: Nov. 11, 2014

(54) BOOT SAVER SYSTEM

(71) Applicant: Bonnie R. Gironella, Dunedin, FL (US)

(72) Inventor: Bonnie R. Gironella, Dunedin, FL (US)

( * ) Notice: Subject to any disclaimer, the term of this patent is extended or adjusted under 35 U.S.C. 154(b) by 0 days.

(21) Appl. No.: 13/907,026

(22) Filed: May 31, 2013

(51) Int. Cl.
*D06C 5/00* (2006.01)
*A47G 25/00* (2006.01)
*A43D 3/14* (2006.01)

(52) U.S. Cl.
CPC ..... *A47G 25/00* (2013.01)
USPC ..... 223/84; 12/128 R

(58) Field of Classification Search
USPC ..... 223/57, 61, 66; 12/114.4, 128 R; 34/104; 36/10; D2/979
See application file for complete search history.

(56) References Cited

U.S. PATENT DOCUMENTS

| | | | | | |
|---|---|---|---|---|---|
| 258,917 | A * | 6/1882 | Hawley | 12/114.4 |
| 2,722,350 | A * | 11/1955 | Kleutgen | 223/75 |
| 3,793,744 | A * | 2/1974 | Saita | 34/104 |
| D276,759 | S * | 12/1984 | Inspector | D2/979 |
| 4,497,080 | A * | 2/1985 | Inspector | 12/128 R |
| 5,570,515 | A * | 11/1996 | Schulte | 34/104 |
| 2002/0000014 | A1 * | 1/2002 | Yanagi | 12/114.2 |

* cited by examiner

*Primary Examiner* — Ismael Izaguirre

(57) ABSTRACT

A base assembly includes two vertical lower segments, one vertical upper segment, and an intermediate segment there between. A cover has linear leg sections covering the lower segments, a head section covering the upper segment, and a shoulder section covering the intermediate segment. Stuffing within the cover is in full contact with the cover and the base assembly.

11 Claims, 3 Drawing Sheets

FIG. 3
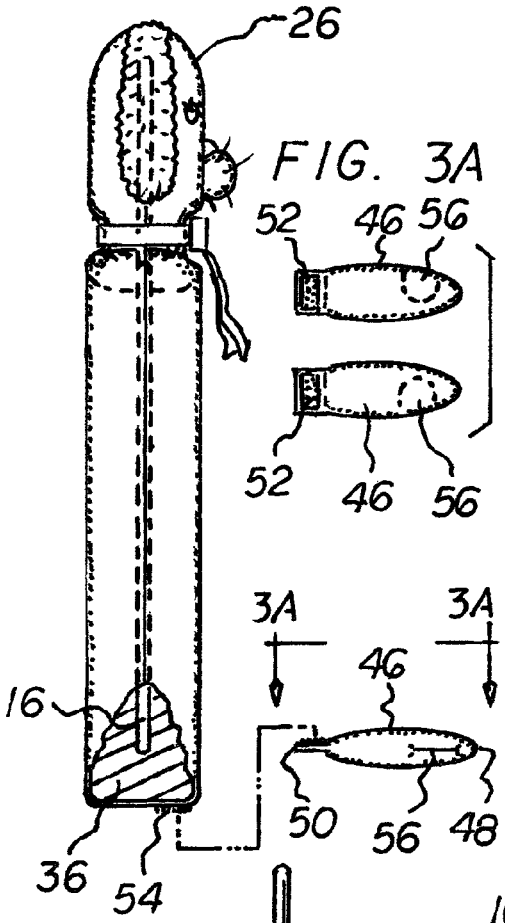
FIG. 3A
FIG. 4
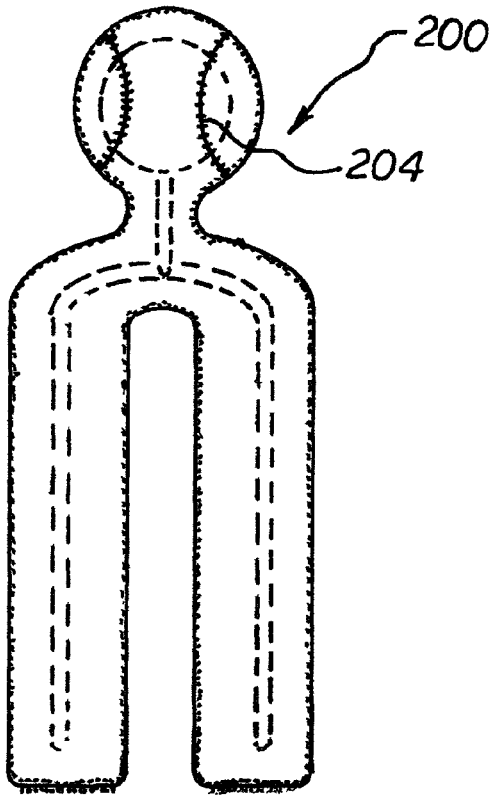
FIG. 5
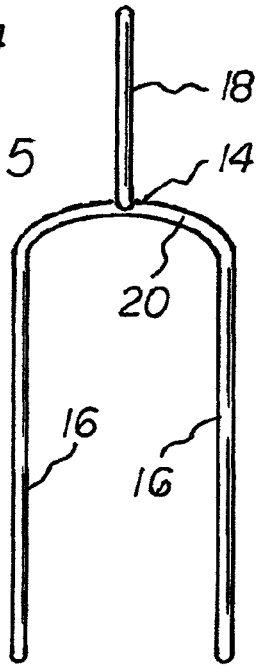
FIG. 6
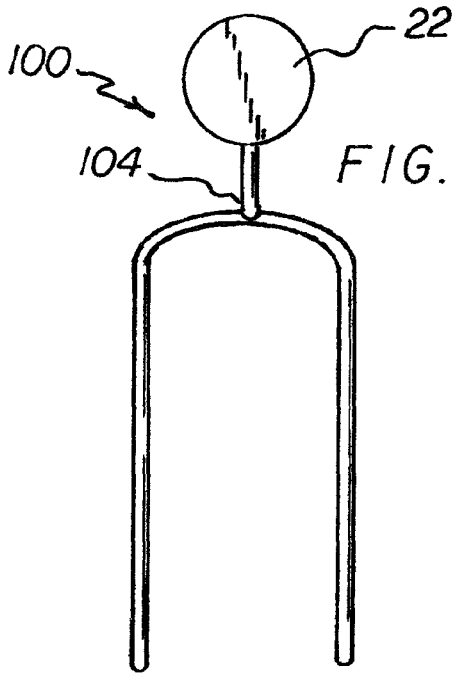

BOOT SAVER SYSTEM

BACKGROUND OF THE INVENTION

Field of the Invention

The present invention relates to a boot saver system and more particularly pertains to providing interior support and exterior protection for boots, the interior support and the exterior protection being achieved in a safe, convenient and economical manner.

SUMMARY OF THE INVENTION

In view of the disadvantages inherent in the known types of boot related devices now present in the prior art, the present invention provides an improved boot saver system. As such, the general purpose of the present invention, which will be described subsequently in greater detail, is to provide a new and improved boot saver system and method which has all the advantages of the prior art and none of the disadvantages.

To attain this, the present invention essentially comprises a base assembly. The base assembly includes two vertical lower segments, one vertical upper segment, and an intermediate segment there between. A cover has linear leg sections covering the lower segments. A head section covers the upper segment. A shoulder section covers the intermediate segment. Stuffing within the cover is in full contact with the cover and the base assembly.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved boot saver system which has all of the advantages of the prior art boot related devices and none of the disadvantages.

It is another object of the present invention to provide a new and improved boot saver system which may be easily and efficiently manufactured and marketed.

It is a further object of the present invention to provide a new and improved boot saver system which is of durable and reliable constructions.

An even further object of the present invention is to provide a new and improved boot saver system which is susceptible of a low cost of manufacture with regard to both materials and labor, and which accordingly is then susceptible of low prices of sale to the consuming public, thereby making such boot saver system economically available to the buying public.

Lastly, another object of the present invention is to provide a boot saver system for providing interior support and exterior protection for boots so as to preserve their shape and condition and extend their service and lifetime, the interior support and the exterior protection being achieved in a safe, convenient and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an exploded side elevational view taken along line 3-3 of FIG. 2.

FIG. 3A is a plan view of a portion of system taken along line 3A-3A of FIG. 3.

FIG. 4 is a plan view similar to FIG. 2 but illustrating an alternate embodiment of the invention.

FIG. 5 is a front elevational view of the base assembly of FIGS. 1-4.

FIG. 6 is a front elevational view similar to FIG. 5 but illustrating an alternate embodiment of the invention.

The same reference numerals refer to the same parts throughout the various Figures.

DESCRIPTION OF THE PREFERRED EMBODIMENT

Figure 1:
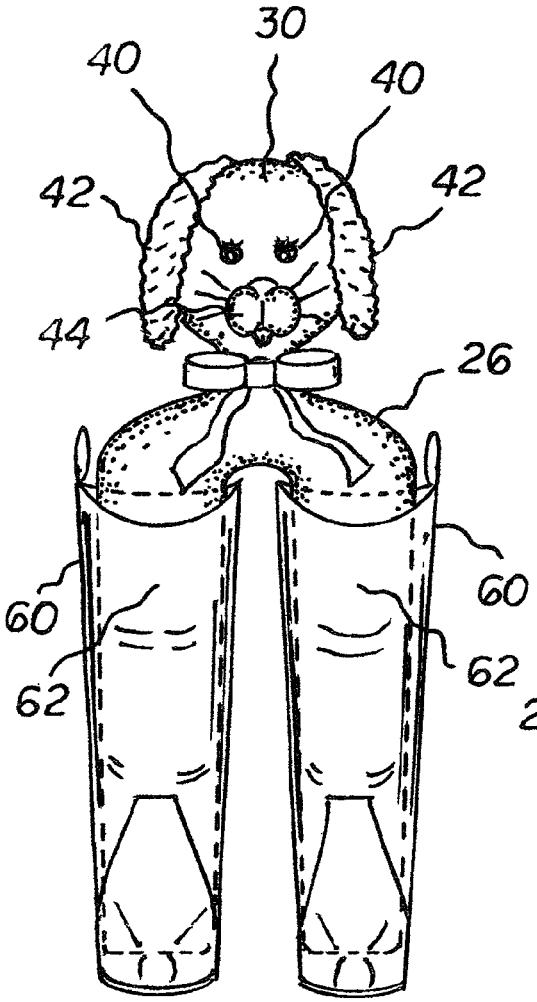
FIG. 1 is a front elevational view of boot saver system constructed in accordance with the principles of the present invention.
Figure 2:
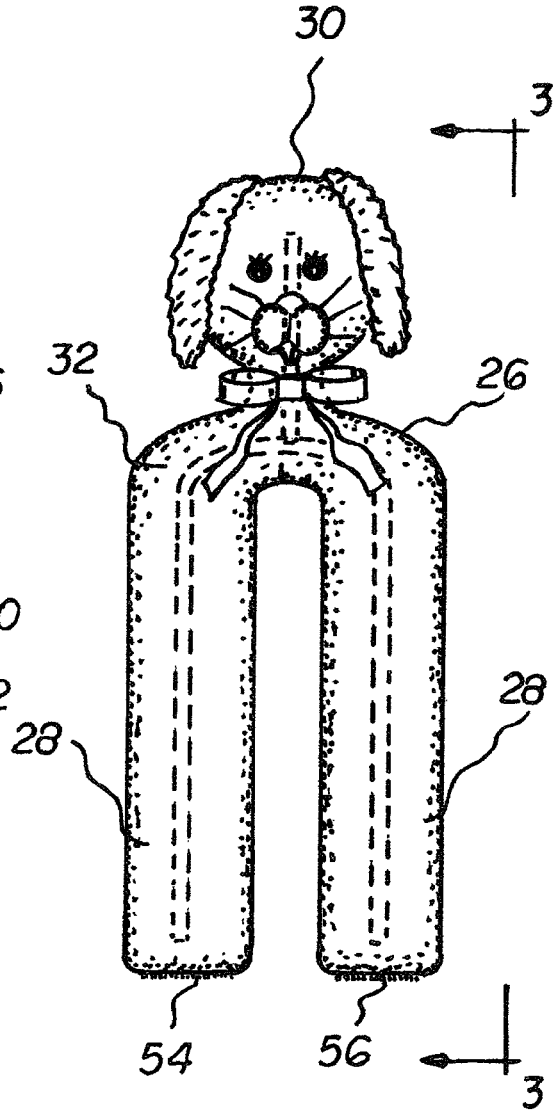
FIG. 2 is a front elevational view similar to FIG. 1 but with the boots removed.
Figure 7:
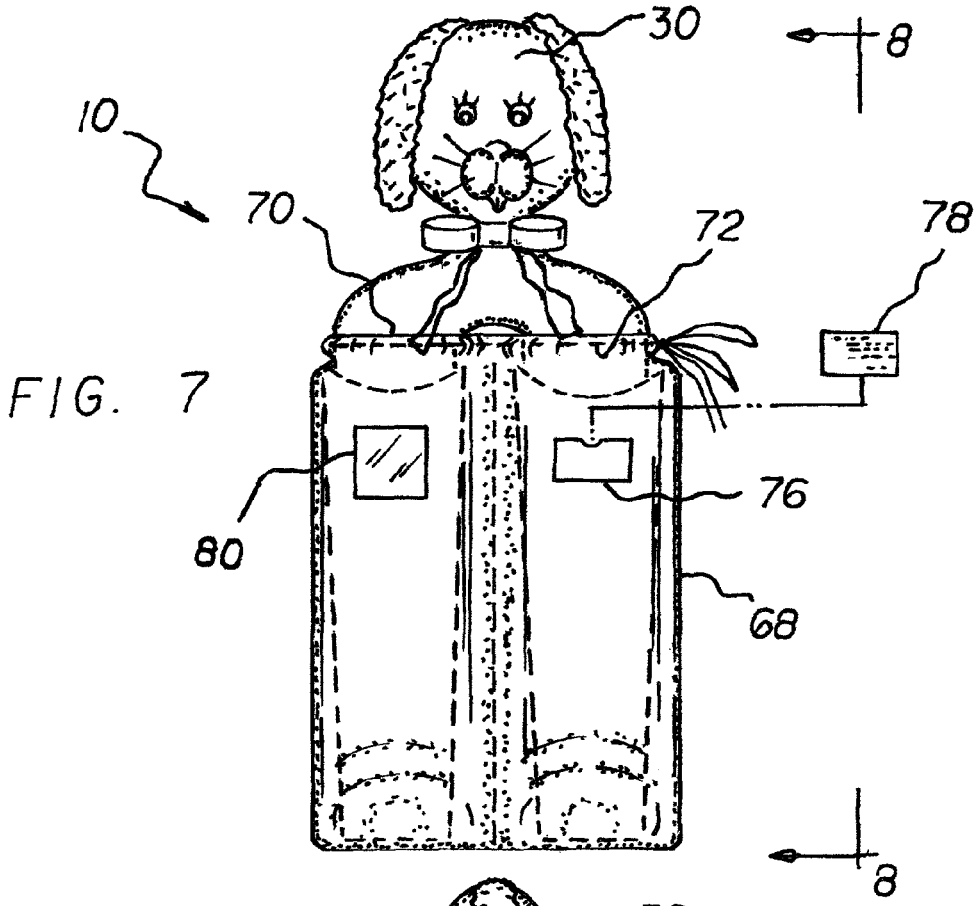
FIG. 7 is a front elevational view similar to FIG. 1 but with the boots and boot saver within a protecting bag.
Figure 8:
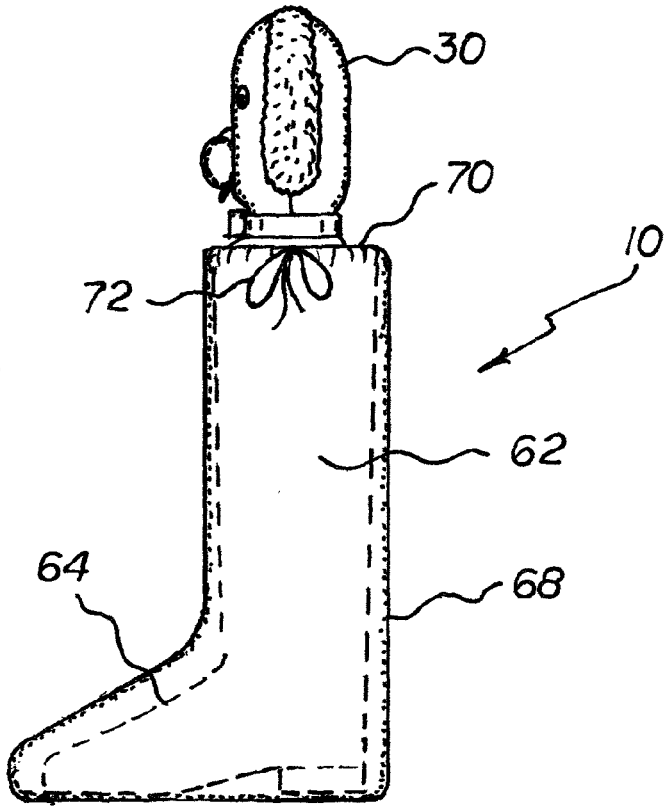
FIG. 8 is an exploded side elevational view taken along line 8-8 of FIG. 7.

With reference now to the drawings, and in particular to FIG. 1 thereof, the preferred embodiment of the new and improved boot saver system embodying the principles and concepts of the present invention and generally designated by the reference numeral 10 will be described.

The present invention, the boot saver system 10 is comprised of a plurality of components. Such components in their broadest context include a base assembly, cover and stuffing. Such components are individually configured and correlated with respect to each other so as to attain the desired objectives.

First provided is a base assembly 14. The base assembly includes two identically configured, parallel, vertically disposed laterally spaced lower segments 16. The lower segments are provided. The base assembly includes one upper segment 18. The upper segment is provided. The upper segment is provided parallel with and laterally intermediate of the lower segments. The base assembly includes an intermediate segment 20. The intermediate section is provided in a downwardly bowed arcuate configuration. The intermediate section has ends. In this manner, the ends form the lower segments and a central extent forms the upper segment. The base assembly includes a circular disk 22. The circular disk is secured to the upper segment above the intermediate segment. The circular disk is adapted for use with any of the various base assemblies. The base assembly in the preferred embodiment is fabricated of bamboo. Alternate materials include an essentially rigid material. The essentially rigid material is chosen from the class of essentially rigid materials. The essentially rigid materials includes plastic and metal. The circular disk is in a plane with the upper and intermediate and lower segments.

A cover 26 is provided. The cover has linear leg sections 28. The leg sections cover the lower segments. The cover has a generally circular head section 30. The head section covers the upper segment. The cover has an arcuate shoulder section 32. The shoulder section covers the intermediate segment. The cover is fabricated of a flexible fabric material.

Stuffing 36 is provided. The stuffing is provided within the cover. The stuffing is provided in full contact with the cover and the base assembly. The stuffing is fabricated of a flexible material. The flexible material is chosen from the class of flexible materials. The class of flexible materials includes natural and synthetic fibers, and blends thereof. The base assembly and the cover and the stuffing constitute a boot saver.

Adornments are provided. The adornment are eyes 40 and ears 42 and a mouth/nose/whiskers 44. The adornments are stitched to the cover, and over the head section. The adornments are provided by an adorning technique chosen from stitching and printing and adhesives and any combination thereof. In this manner the appearance of an animal face is created. Other adornments include the design of any object including, but not limited to, a baseball, football, plant, tree, corporate logo, and the like.

Two similarly configured foot components 46 are provided. Each foot component has a pointed forward end 48. Each foot component has a flat rearward end 50. An upwardly facing hook and loop fastener 52 is provided on each rearward end. Co-operable downwardly facing hook and loop fasteners 54 are provided on a lower extent of each leg section of the cover. The hook and loop fasteners of the cover and of the foot components are adapted to releasably couple the foot components to the leg sections. Stuffing is provided within the foot components. Each side of each foot component has a pocket 56. In this manner removable receipt of treasures is allowed.

A pair of boots 60 is provided next. The boots have leg parts 62. The boots have foot parts 64. The leg parts receive the leg sections of the cover. The foot parts receive the foot components.

Further provided is a protective bag 68. The protective bag removably receives the boots and the foot components. The protective bag has an open top 70 with two laterally spaced chambers secured by ties coupling the chambers. The open top has a constrictor 72 in the form of a draw string or an elastic band or the like. The constrictor is adapted to encompass the cover adjacent to the shoulder portion or at any elevational location. The protective bag is fabricated of any material, plastic or fibers, natural or synthetic, woven or knitted, or any combination thereof.

Provided next is a transparent pocket 76. The transparent pocket is provided on an exterior surface of the protective bag. An indicia card 78 is provided. The indicia card is removably positioned in the transparent pocket. The indicia card is for the purpose of categorizing and inventorying the boots within the protective bag and for similar purposes. A transparent window 80 is on an exterior surface of the protective bag for a quick visual inspection of the boots within the protective bag.

An alternate embodiment 100 of the present invention is provided. A base assembly 104 is provided. The base assembly is fabricated of an essentially rigid material. The essentially rigid material is chosen from the class of essentially rigid materials. The class of essentially rigid materials includes bamboo, plastic and metal.

Another alternate embodiment 200 of the present invention is provided. An adornment is provided in the form of printing 204 on the cover over the head section.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A boot saver system comprising:

a skeletal structural base assembly including two identically configured, parallel, vertically disposed laterally spaced lower segments, the skeletal structural base assembly also including one upper segment extending above the lower segments, the skeletal structural base assembly also including an intermediate segment with ends connected to the lower segments and a central extent connected to the upper segment thereby forming the skeletal structural base assembly, the skeletal structural base assembly being fabricated of an essentially rigid material chosen from the class of essentially rigid materials including bamboo, plastic, and metal;

a cover having linear leg sections covering the lower segments, a head section covering the upper segment, and a shoulder section covering the intermediate segment; and stuffing within the cover in full contact with the cover and the skeletal structural base assembly.

2. The system as set forth in claim 1 and further including:

adornments on the cover, and over the head, the adornments being in the form of objects.

3. The system as set forth in claim 2 wherein the adornments are provided by an adorning technique chosen from stitching and printing and adhesives and any combination thereof.

4. The system as set forth in claim 1 and further including:

adornments in form of eyes and ears and a mouth/nose and whiskers stitched to the cover, and over the head section to create the appearance of an animal face.

5. The system (200) as set forth in claim 1 and further including:

adornment in the form of printing (204) on the cover, and over the head section.

6. The system as set forth in claim 1 and further including foot components coupled to the leg sections.

7. The system as set forth in claim 1 and further including foot components releasably coupled to the leg sections.

8. The system as set forth in claim 1 and further including:

two similarly configured foot components, each foot component having a pointed forward end and a flat rearward end, an upwardly facing hook and loop fastener on each rearward end, co-operable downwardly facing hook and loop fasteners on a lower extent of the leg sections of the cover, the hook and loop fasteners of the cover and of the foot components adapted to releasably couple the foot components to the leg sections, and stuffing within the foot components.

9. The system as set forth in claim 4 and further including:

a pair of boots, each boot having leg parts and foot parts, the leg parts receiving the leg sections of the cover, the foot parts receiving the foot components.

10. The system as set forth in claim 5 and further including:

a bag removably receiving the boots and the leg sections and the foot components, the bag having an open top with two laterally spaced chambers, the open top having a constrictor chosen from the class of constrictors including draw strings, elastic loops and the like, the constrictor adapted to encompass the cover adjacent to the shoulder section.

11. A boot saver system (10) for providing interior support and exterior protection for boots, the interior support and the exterior protection being achieved in a safe, convenient and economical manner, the system comprising, in combination:

a base assembly (14) including two identically configured, parallel, vertically disposed laterally spaced lower segments (16), the base assembly including one upper segment (18) parallel with and intermediate of the lower segments, the base assembly including an intermediate segment (20) in a downwardly bowed arcuate configuration with ends forming the lower segments and a central extent forming the upper segment, the base assembly including a circular disk (22) secured to the upper segment above the intermediate segment, the base assembly being fabricated of bamboo, the circular disk being in a plane with the upper and intermediate and lower segments;

a cover (26) having linear leg sections (28) covering the lower segments, a generally circular head section (30) covering the upper segment, and an arcuate shoulder section (32) covering the intermediate segment, the cover being fabricated of a flexible fabric material;

stuffing (36) within the cover in full contact with the cover and the base assembly, the stuffing being fabricated of a flexible material chosen from the class of flexible materials including natural and synthetic fibers and blends thereof, the base assembly and the cover and the stuffing constituting a foot saver;

adornments in form of eyes (40) and ears (42) and a mouth/nose/whiskers (44) stitched to the cover over the head section to create the appearance of an animal face;

two similarly configured foot components (46), each foot component having a pointed forward end (48) and a flat rearward end (50), an upwardly facing hook and loop fastener (52) on each rearward end, co-operable downwardly facing hook and loop fasteners (54) on a lower extent of the leg sections of the cover, the hook and loop fasteners of the cover and of the foot components adapted to releasably couple the foot components to the leg sections, stuffing within the foot components, a pocket (56) in a side of each foot component to allow for the removable receipt of treasures;

a pair of boots (60) having leg parts (62) and foot parts (64), the leg parts receiving the leg sections of the cover, the foot parts receiving the foot components;

a protective bag (68) removably receiving the boots and the foot components, the protective bag having an open top (70) with a constrictor (72) adapted to encompass the cover adjacent to the shoulder portion; and a transparent pocket (76) on an exterior surface of the protective bag and an indicia card (78) removably positioned in the transparent pocket, the indicia card being for the purpose of categorizing and inventorying boots within the protective bag and for like purposes, and a transparent window (80) on an exterior surface of the protective bag for a quick visual identification of the boots within the protective bag.

* * * * *